US006033188A

United States Patent [19]

Baldus et al.

[11] Patent Number: 6,033,188

[45] Date of Patent: Mar. 7, 2000

[54] MEANS AND METHOD FOR VARYING MARGIN PRESSURE AS A FUNCTION OF PUMP DISPLACEMENT IN A PUMP WITH LOAD SENSING CONTROL

[75] Inventors: Jeffrey A. Baldus, State Center; David D. Dirks; Kerry G. Geringer, both of Ames, all of Iowa

[73] Assignee: Sauer Inc., Ames, Iowa

[21] Appl. No.: 09/032,052

[22] Filed: Feb. 27, 1998

[51] Int. Cl.[7] ..... F04B 1/26

[52] U.S. Cl. ..... 417/222.1; 417/53

[58] Field of Search ..... 417/222.1, 213, 417/53, 218; 60/469

[56] References Cited

U.S. PATENT DOCUMENTS

| | | | |
|---|---|---|---|
| 3,987,622 | 10/1976 | Johnson | 60/420 |
| 4,013,381 | 3/1977 | Hein et al. | 417/222 |
| 4,034,564 | 7/1977 | Johnson et al. | 60/445 |
| 4,074,529 | 2/1978 | Budzich | 60/445 |
| 4,116,587 | 9/1978 | Liesener | 417/212 |
| 4,189,921 | 2/1980 | Knapp | 60/445 |
| 4,196,588 | 4/1980 | Johnson | 60/445 |
| 4,381,647 | 5/1983 | Ruseff | 60/452 |
| 4,518,322 | 5/1985 | Nonnenmacher | 417/222 |
| 4,745,746 | 5/1988 | Geringer | 60/477 |
| 5,123,815 | 6/1992 | Larkin et al. | 417/222 |
| 5,187,933 | 2/1993 | Nikolaus | 60/452 |
| 5,503,534 | 4/1996 | Rhody | 417/218 |
| 5,533,867 | 7/1996 | Strenzke | 417/53 |
| 5,579,642 | 12/1996 | Wilke et al. | 60/426 |
| 5,588,805 | 12/1996 | Geringer | 417/53 |

*Primary Examiner*—Thomas N. Moulis
*Assistant Examiner*—Mahmoud M. Gimie
*Attorney, Agent, or Firm*—Zarley, McKee, Thomte, Voorhees & Sease

[57] ABSTRACT

A pump system includes a variable fluid displacement pump having a pressure line which is connected to a pressure load and connected to a load sensing control. A variable orifice is located downstream from the load sensing control. The variable orifice is fluidly connected to the load sensing control in a servo pressure conduit such that the margin pressure varies proportionally with respect to the fluid displacement Of the pump. The variable orifice can take many different forms, including a variable cross sectional area gap between the housing and an elongated servo piston longitudinally slidable therein. A longitudinal slot having uniformly increasing depth along the length of the servo piston gives the servo piston a cross sectional area which varies along its length. Thus, a variable orifice results.

9 Claims, 6 Drawing Sheets

| APPROVED BY DRAFTSMAN | O.G. FIG. | |
|---|---|---|
| | CLASS | SUBCLASS |
| | | |

MEANS AND METHOD FOR VARYING MARGIN PRESSURE AS A FUNCTION OF PUMP DISPLACEMENT IN A PUMP WITH LOAD SENSING CONTROL

BACKGROUND OF THE INVENTION

The present invention relates to the field of hydraulic pumps. More particularly, the present invention relates to a means and method for varying the margin pressure or delta pressure across a load sensing valve in an open circuit pump system. The invention provides better operator control of working functions on equipment such as backhoes and the like.

Some backhoe manufacturers have sought an open circuit pump control system with a load sensing control valve that has a delta pressure across the valve which varies with the displacement of the pump. Thus, there is a need for a means and method to accomplish this in an open circuit application.

Therefore, a primary objective of the present invention is the provision of an open circuit pump system having a load sensing control valve and a variable orifice associated with the servo pressure conduit thereof such that the delta pressure or margin pressure across the load sensing valve varies based upon the fluid displacement of the pump.

Another objective of the present invention is the provision of a variable orifice located in the servo pressure conduit and defined by a gap formed between the housing and a servo piston slidable within the housing.

Another objective of the present invention is the provision of a servo piston having a longitudinal slot therein which has a depth that uniformly increases along the length of the servo piston so as to define a variable orifice area.

Another objective of the present invention is the provision of a servo piston having a slot whose depth varies uniformly along a straight tapered bottom surface.

A further objective of the present invention is the provision of a method of varying the fluid pressure differential across a load sensing valve in a variable displacement open circuit pump.

A further objective of the present invention is the provision of a pump system that is economical to produce, durable, and reliable in use.

These and other objectives will be apparent from the drawings, as well as the written description and claims which follow.

SUMMARY OF THE INVENTION

This invention relates to a pumping system and provides a means and method for varying the margin pressure or delta pressure across a load sensing valve in such a system.

A variable displacement open circuit pump fluidly connects to a fluid pressure load. A load sensing control valve is interposed between the output pressure line of the pump and a load pressure sensing signal line in order to control the displacement of the pump. Pump displacement is altered by a servo piston assembly that moves the swashplate of the pump in response to a flow of pressurized fluid delivered through a servo pressure conduit from the load sensing control valve.

The serve piston assembly includes an elongated servo piston slidably mounted in a bore adjacent one end of the tillable swashplate. The extension or retraction of the servo piston determines the position of the swashplate and therefore the fluid displacement of the pump. A slot having a variable cross section extends longitudinally along the servo piston. Conceptually, the tapered slot or groove and the bore surrounding the servo piston define a variable orifice which allows leakage that is proportional to the displacement of the pump. The leakage results in a margin pressure between the servo piston and the load sensing control that is variable, rather than constant as is found in conventional open circuit pumps with load sensing controls.

DETAILED DESCRIPTION OF THE PREFERRED EMBODIMENT

Figure 1:
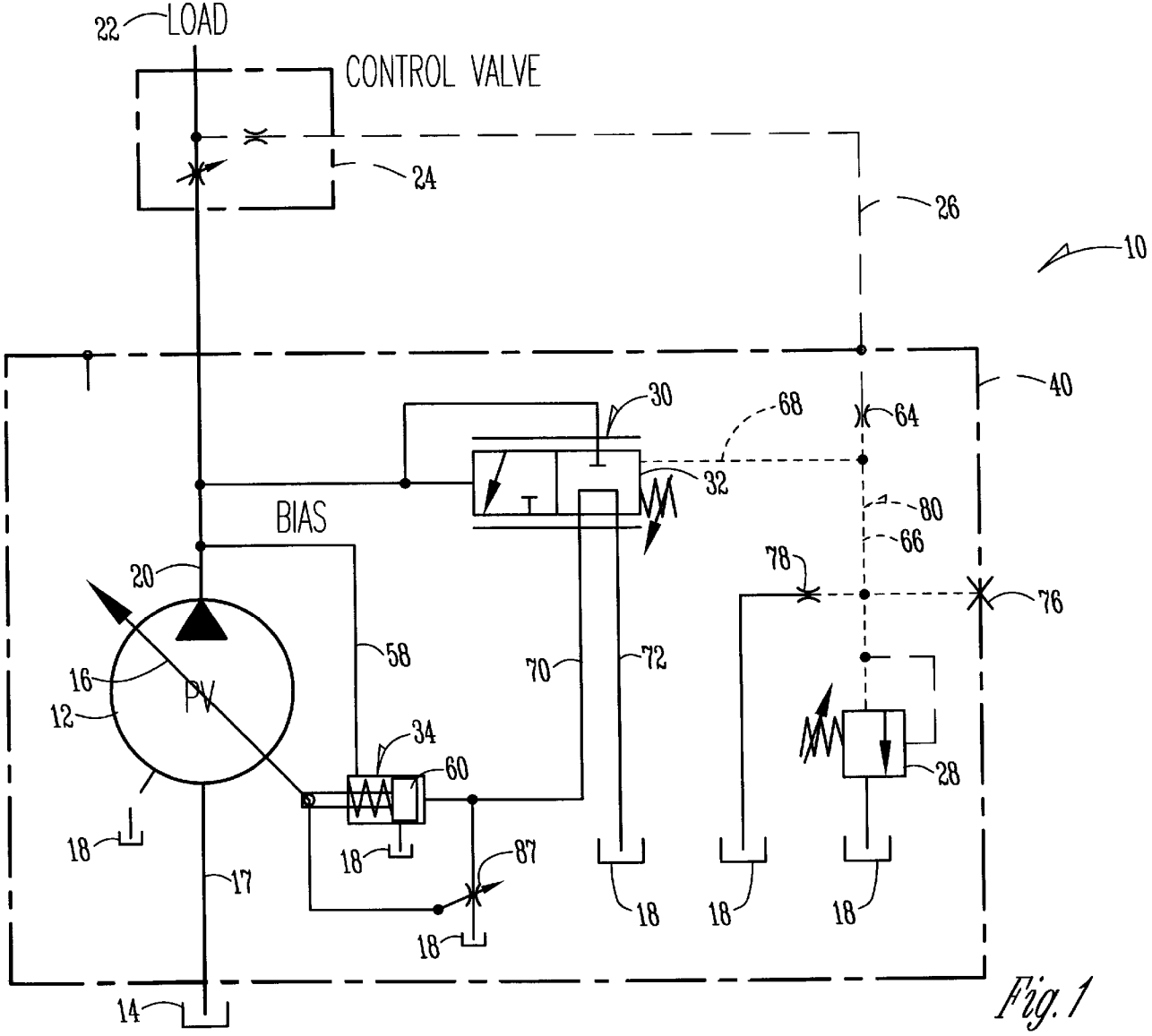
FIG. 1 is a hydraulic schematic diagram of an open circuit pump system equipped with the present invention.

The hydraulic schematic diagram of FIG. 1 discloses an open circuit pump system 10 equipped with the present invention. The pumping system 10 includes a variable fluid displacement open circuit pump 12 which draws fluid from a hydraulic reservoir 14 and pressurizes it. A movable swashplate 16 varies the displacement of the pump 12. The pump 12 draws fluid from the reservoir 14 through a suction line 17. Internal case drain lines 18 are fluidly connected to the pump 12 to return any internal leakage to the pump casing and eventually to the main hydraulic reservoir 14. The pump 12 has an output pressure line 20 which is fluidly connected to a fluid pressure load 22. The load 22 can be a hydraulic cylinder or similar working implement on a machine. For example, the load might be a cylinder attached to the hoe arm on a backhoe.

A load control valve 24 is provided upstream of the load 22 on the output pressure line 20. A load sensing signal line 26 feeds a signal indicative of the load back to the pump 12. The load sensing signal (line) 26 also fluidly connects a pressure compensating pilot valve 28 and a load sensing control 30 to the load control valve 24. The pressure compensating pilot valve 28 is adjustable and can be set to a desired pressure setting.

The load sensing control 30 includes an infinitely positionable spool 32. The control 30 is adjustable, as shown schematically by the arrow through the spring symbol on the right hand end of the spool 32. Depending upon the magnitude of the load sensing signal 26 and the pressure in the output line 20, the spool 32 will modulate between the two positions shown to set the fluid displacement of the pump 12. When the control is in the open position, control fluid is ported to the servo piston assembly 34, which is mechanically connected to the swashplate 16 of the pump 12. A passage 58 feeds a bias signal from the pump output pressure line 20 to one side of the servo piston assembly 34 so that the swashplate 16 is normally biased to a full stroke position wherein the fluid displacement of the pump 12 is maximized. When the load sensing control 30 ports oil to the right end of the servo piston assembly 34, as shown in FIG. 1, the swashplate 16 of the pump 12 is moved away from the maximum displacement position.

Figure 2:
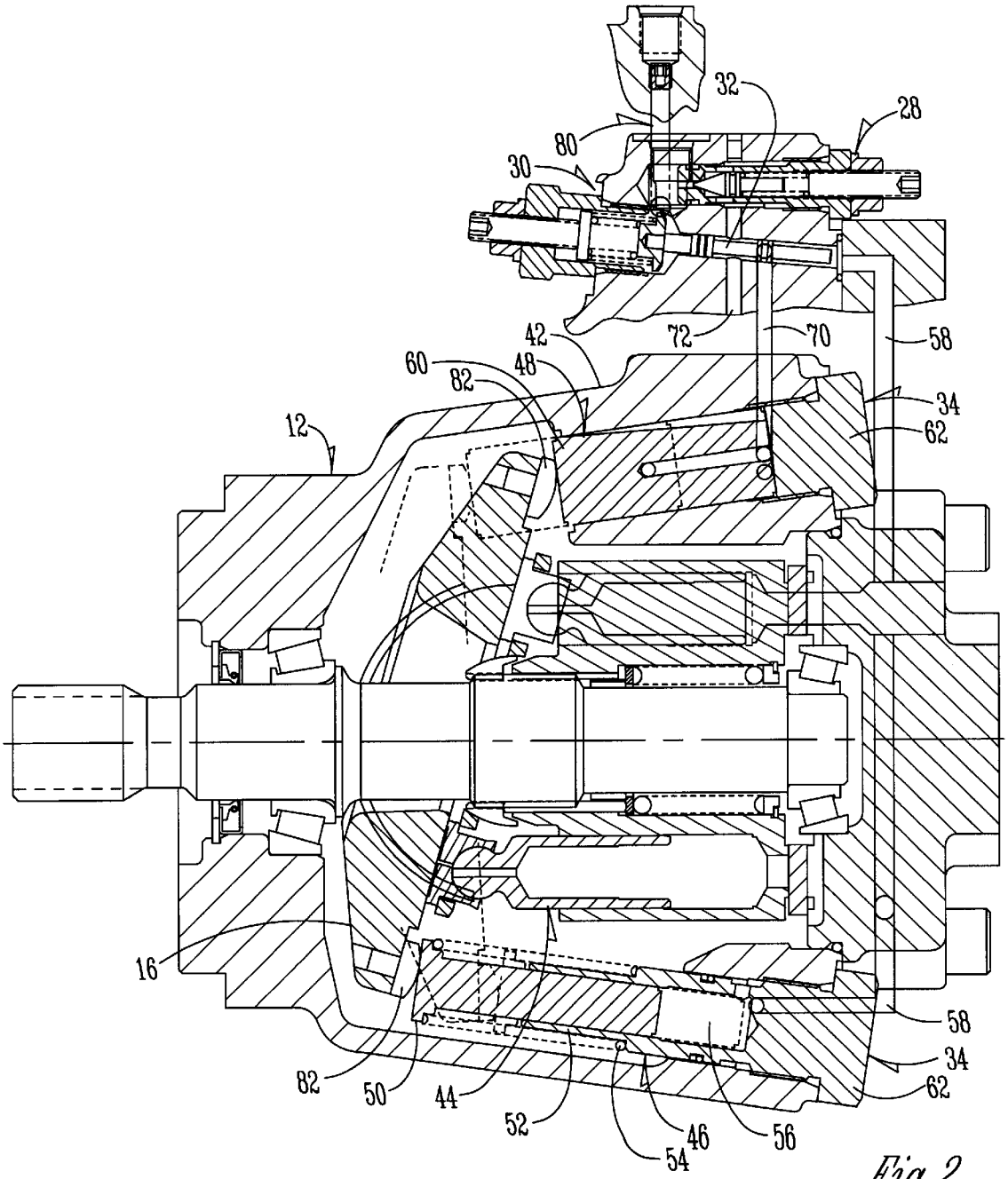
FIG. 2 is a sectional view of the open circuit pump, servo piston, and load sensing control valve from FIG. 1.

FIG. 2 is a cross-sectional view of the physical hardware corresponding to the circuit shown in FIG. 1. The portion on the left in FIG. 2 is the pump 12 and part of the servo piston assembly 34. The pump 12 has a housing 42 within which the swashplate 16 and a conventional open circuit axial piston rotating group 44 are contained.

In FIG. 2, the servo piston assembly 34, which was schematically simplified in FIG. 1, is shown to have two elements 46, 48. The elements 46, 48, respectively, engage different sides of the tillable swashplate 16. Element 46 strokes the pump and element 48 destrokes it.

Stroking element 46 includes a stop element 50 for contacting the swashplate 16. A hollow guide element 52 guidingly supports the stop element 50. A spring 54 engages the stop element 50 and the guide element 52 so as to urge the stop element 50 into the swashplate 16, even in the absence of pump output pressure. A cavity 56 exists within the guide element 52 below the stop element 50. The cavity 56 communicates with the output pressure line 20 of the pump 12 through the internal passage 58 illustrated on FIGS. 1 and 2. Pressure in the passage 58 biases the stop element 50 into the swashplate 16. Thus, the swashplate is always urged toward full stroke or a maximum displacement position.

On the other side of the swashplate 16, the destroking element 48 includes an elongated, substantially cylindrical servo piston 60. The servo piston 60 slidably mounts in the pump housing 42. A threaded cap 62 mounts on the housing 42 to keep the servo piston 60 in the housing 42.

Figure 3:
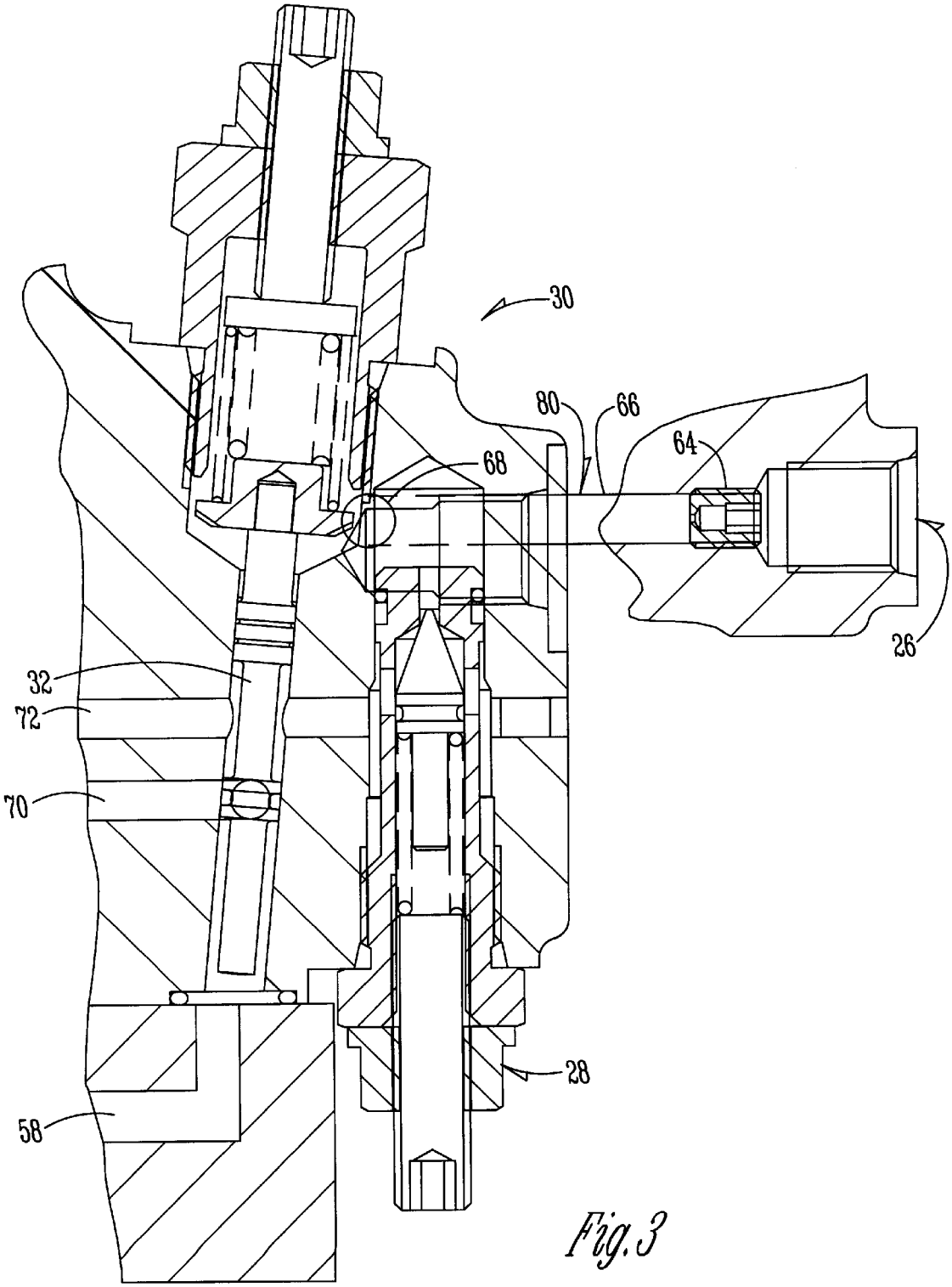
FIG. 3 is an enlarged sectional view of the load sensing control, valve shown in FIG. 2.

The load sensing control 30 and the pressure compensating pilot valve 28 can be mounted remotely or in the pump housing 42. The load sensing control valve 30 and pressure compensating pilot valve 28 are shown more clearly in FIG. 3. An orifice 64 is interposed between the load control valve 24 and the load sensing control 30, as shown in FIGS. 1–3.

The pressure compensating pilot valve 28 is conventional and well known. Thus, in and of itself, it is not the subject of this invention. Various fluid passageways 58, 66, 68, 70 and 72 extend through the housing 42 and the end cap 74 provided thereon, as shown in FIGS. 1 and 2. Passageway 70 is referred to hereinafter as the servo pressure conduit.

Referring again to FIG. 1, a remote pressure compensation port 76 is included in the circuit and is indicated by X at the right hand end of FIG. 1. An optional orifice 78 can also be provided in the circuit with a fluid connection to the case drain 18. Thus, it will be understood that the load sensing control 30, the orifices 64, 78, the remote pressure compensation port 76 and the pressure compensating pilot valve 28 define the boundaries of a load sensing control gallery 80. The load sensing control gallery 80 is defined as the cavity within the load sensing control portion of the circuit that is uniformly at load sensing pressure. The term "uniformly at load sensing pressure" is a determinate qualifier for the confines of this cavity or gallery such than no flow paths or restrictions are traversed. Fluid passageways 66 and 68 extend through the load sensing control gallery 80. Short dashed lines have been added to FIG. 1 to show the load sensing control gallery 80. The load sensing control gallery 80 can also be seen in FIGS. 2 and 3, between the orifice 64, the pressure compensating pilot valve 28, the spool 32 of the load sensing control 30, and the orifice 78 (FIG. 1).

Figure 4:
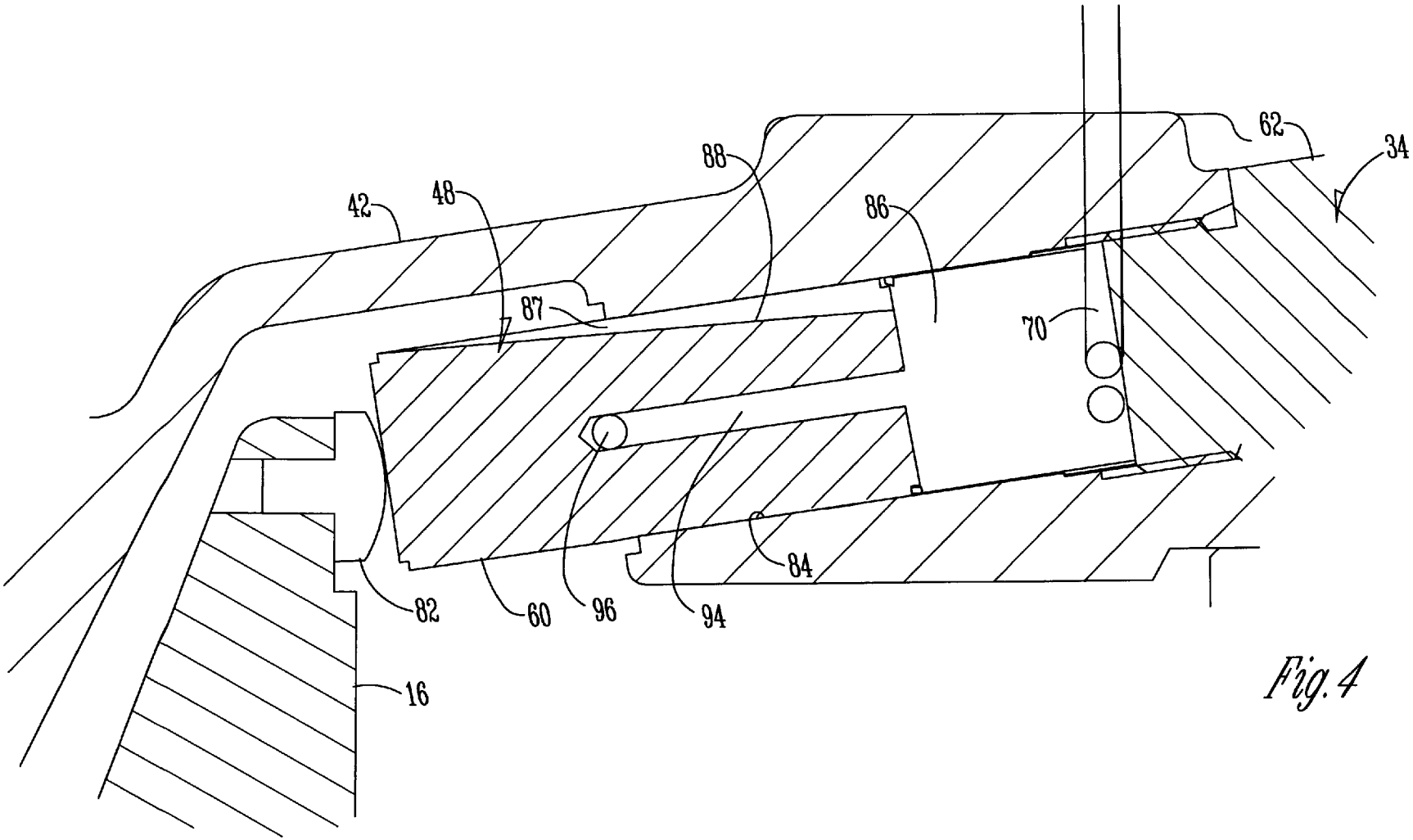
FIG. 4 is an enlarged sectional view of the servo piston area of the pump in FIG. 2, except the servo piston has been hydraulically extended to destroke the pump and increase the size of the variable orifice.
Figure 6:
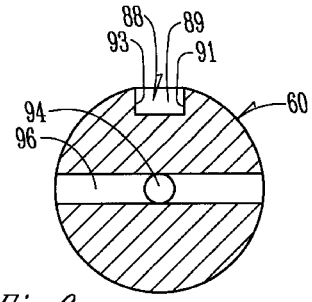
FIG. 6 is a transverse cross sectional view of the servo piston taken along lines 6—6 in FIG. 5.

One important element of the present invention is the structure of the destroking element 48. Referring to FIG. 4, the destroking element 48 is hydraulically urged into contact with the swashplate 16. A hardened reaction pad 82 can be attached to the swashplate at the point of contact with the servo piston 60 to minimize the wear and improve the durability of the product. A similar reaction pad 82 can be provided on the stroking side of the swashplate 16 (FIG. 2). The reaction pads 82 have rounded heads so as to provide a plurality of contact points as the swashplate 16 rotates.

The servo piston 60 is slidable in a tightly formed bore 84 in the housing 42. Passage 70 is fluidly connected to the lower end of the bore 84. The command signal provided by the load sensing control 30 enters the cavity 86 behind the servo piston 60. The fluid pressure in the cavity 86 acts upon the bottom of the servo piston 60 and urges it outwardly toward the swashplate 16. In response, the swashplate 16 tilts toward a minimum fluid displacement position. As the swashplate 16 moves to a more perpendicular attitude with respect to the rotating group 44, the fluid displacement of the pump 12 is reduced. In other words, the pump 12 is destroked.

Figure 5:
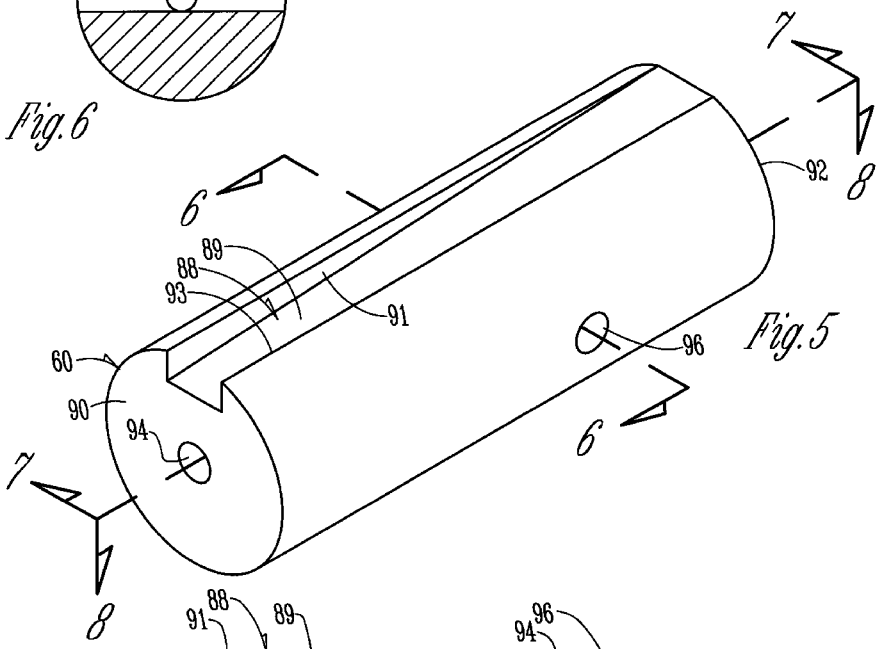
FIG. 5 is an enlarged perspective view of the servo piston of this invention.

FIG. 5 shows that the servo piston 60 is substantially cylindrical. The housing 42 includes a bore 84 therein for receiving the servo piston 60. The bore 84 should substantially correspond to the shape of the servo piston 60 so that the servo piston 60 is slidable in the bore 84.

Figure 7:
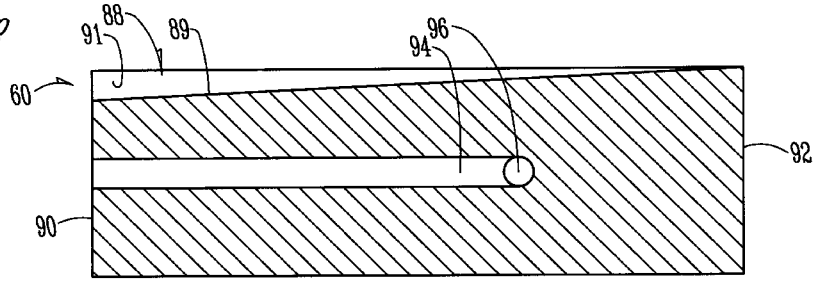
FIG. 7 is a longitudinal cross sectional view of the servo piston taken along line 7—7 in FIG. 5.
Figure 8:
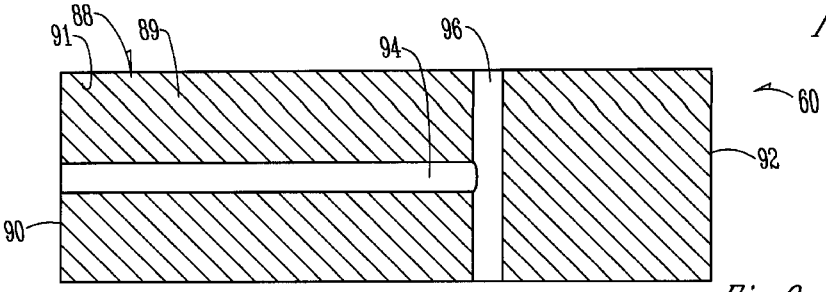
FIG. 8 is a longitudinal cross sectional view of the servo piston taken along line 8—8 in FIG. 5.

The servo piston 60 has a slot 88 therein which is tapered in depth and extends longitudinally along the elongated servo piston 60. Preferably, the slot 88 is rectilinear and extends completely from one end 90 to the other 92 end of the servo piston 60. The depth of the slot 88 increases uniformly along the length of the servo piston 60, as best seen in FIG. 7. The slot 88 includes a bottom surface 89 which is intersected by opposing sides 91, 93. It will be appreciated that other types (cross sections) of slots can be provided. Furthermore, the cross sectional area of the slot could also vary nonuniformly, but in a predictable manner without detracting from the invention. The slot 88 merely needs to vary or take on a specific configuration that varies predictably with the fluid displacement of the pump 12.

The servo piston 60 has a central longitudinal bore 94 therein, which intersects a cross hole 96 intermediate the ends 90, 92 of the servo piston 60. The bores 84, 94, and the cross hole 96 are positioned to provide an "over center valve". This optional over center valve relieves servo pressure to the case drain 18 whenever the pump 12 overshoots and goes "over center" or beyond the standby or minimum displacement position.

In the preferred embodiment, the elongated servo piston 60 is always in contact with the reaction pad 82 on the swashplate 16, and thus slides in and out of the bore 84 axially or longitudinally in proportion to the displacement of the pump 12. The fully extended position shown in FIG. 4 corresponds to the minimum displacement of the pump 12, while the fully retracted position shown in FIG. 9 corresponds to the maximum displacement of the pump 12. The servo piston 60 can also be positioned anywhere in between the retracted and extended positions shown.

Figure 9:
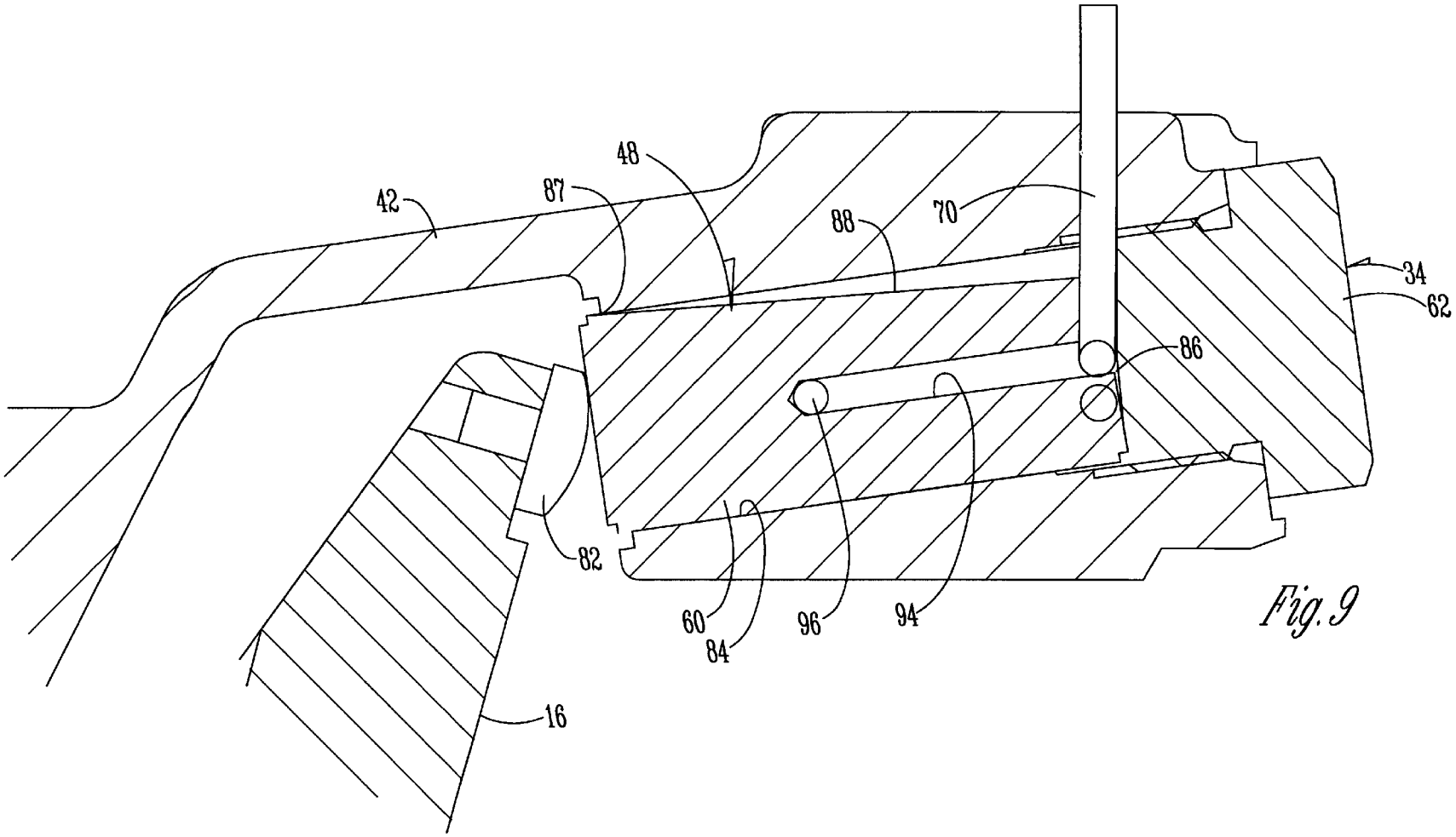
FIG. 9 is an enlarged sectional view of the servo piston area in FIG. 2, similar to FIG. 4, but shows the servo piston retracted in the bore and size of the variable orifice decreased accordingly.

With the servo piston 60 configured as shown in FIGS. 4–9, the slot 88 acts as a variable (cross sectional area) orifice 87 (schematically represented in FIG. 1) and allows pressurized fluid to escape from the cavity 86 and into the casing of the pump 12. As FIG. 4 shows, the variable orifice 87 is largest when the servo piston 60 is fully extended from the bore 84, which corresponds to the minimum fluid displacement position of the swashplate 16. In FIG. 9, the variable orifice 87 defined by the slot 88 is at a minimum. The servo piston 60 is forced to retract by the swashplate 16 tilts to a position corresponding to maximum fluid displacement of the pump 12.

In operation, the open circuit pump system 10 of this invention provides a means and method for varying the fluid pressure differential across the load sensing (displacement) control 30. An understanding of the term "margin pressure" is necessary to understand and fully appreciate the operation of the invention. Margin pressure is defined as the difference between system pressure, which is found in the output pressure line 20, and the pressure in the load sensing control gallery 80. In an abbreviated sense, the margin pressure is the delta pressure across the load sensing control 30. The load sensing control 30 modulates pressure flow to the servo piston 60, which reacts by moving the swashplate 16 to change the fluid displacement of the pump 12 in order to provide sufficient flow to the load 22 to maintain the margin pressure.

Without the unique servo piston assembly and hydraulic circuitry of this invention, the margin pressure is constant when modulating the load sensing control in conventional open circuit pumps with load sensing controls. However, the variable orifice 87 created by the longitudinal slot 88 in the servo piston 60 provides a margin pressure that varies with some relationship to the displacement of the pump 12. This provides the operator with different control characteristics at different levels of pump displacement.

Normally, the open circuit pump 12 is biased to maximum displacement and the servo piston 60 is fully retracted in the bore 84 as shown in FIG. 9. When the load sensing control 30 dictates, the pump 12 is destroked from maximum displacement (FIG. 9) to a standby condition or minimum displacement (FIG. 4). Because of the slot 88, there will be an increased amount of leakage from the servo piston 60 while it is extended. This adds increased damping to the control system near the standby or minimum displacement condition.

However, as the load sensing control dictates, the stroking element 46 on the other side of the swashplate 16 urges the swashplate 16 to a full stroke or maximum displacement condition. Thus, the swashplate 16 pushes the servo piston 63 into a retracted position as shown in FIGS. 2 and 9. In the retracted position, the tapered slot 88 is basically sealed off by the walls of the bore 84. Thus, there is little leakage from the servo piston 60 to the case drain 18. Thus, the servo piston 60 is more sensitive or responsive to the pressure command signal from the load sensing control 30. Consequently, the system is more responsive to varying load conditions.

Once the pump system 10 reaches the desired flow setting of control valve 24, the load sensing control 30 modulates the output flow of the pump 12 by supplying a flow of pressurized fluid to the cavity 86 behind the servo piston 60. The flow of pressurized fluid is supplied through the servo pressure conduit (passage 70). The servo piston reacts by moving longitudinally in the bore 84 to set the swashplate 16 in an angular position corresponding to the desired output flow of the pump 12. Because the servo piston 60 moves longitudinally in the bore 84 to set the displacement of the pump 12, the slot 88 which runs longitudinally on the servo piston 60 creates a variable cross section orifice 87 that varies in relation with the displacement of the pump 12.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A pump system comprising:

a variable fluid displacement pump including a pump housing and a swashplate movably mounted in said pump housing for varying the fluid displacement of said pump;

a servo having a hydraulically movable servo piston mechanically coupled to said swashplate;

a pump pressure line fluidly connected to a fluid pressure load;

a load sensing control operatively connected by said pump pressure line to said pump and by a load sensing signal line to said pressure load;

a variable orifice located downstream from said pump and said load sensing control, said variable orifice being fluidly connected by a servo pressure conduit to the load sensing control such that the difference in the fluid pressure in said pump pressure line and the pressure sensed by said load sensing control varies proportionally in relation to the magnitude of the fluid displacement of said pump;

the variable orifice being at least partially delimited by said servo piston such that said orifice is variable in size based upon movement of said servo piston and thereby controlled by mechanical feedback regarding the position of the swashplate.

2. A pump system comprising:

a variable fluid displacement pump having a pump pressure line fluidly connected to a fluid pressure load;

a servo connected to said pump for varying the fluid displacement of the pump, said servo including an elongated servo piston slidably mounted in a servo housing;

a load sensing control operatively connected by said pump pressure line to said pump, said load sensing control being operatively connected to said pressure load by a load sensing signal line, and said load sensing control also being operatively connected to said servo for varying the fluid displacement of said pump;

a variable orifice associated with the servo and located downstream from said pump and said load sensing control, said variable orifice being fluidly connected by a servo pressure conduit to the load sensing control such that the difference in the fluid pressure in said pump pressure line and the pressure sensed by said load sensing control varies proportionally in relation to the magnitude of the fluid displacement of said pump;

the variable orifice being defined by a gap formed between the servo housing and the elongated servo piston, the gap resulting from the elongated servo piston having a transverse cross sectional area that varies along the length thereof.

3. The pump system of claim 2 wherein the servo piston is cylindrical and has a length and an outer diameter with a slot extending longitudinally therein, the slot having at least one dimension which uniformly varies along the length of the servo piston.

4. The pump system of claim 3 wherein the slot has a depth which uniformly varies along a straight tapered bottom surface along the length of the slot.

5. The pump system of claim 2 wherein the pump has a housing and the servo housing comprises a cylindrical servo bore integrally formed within the pump housing.

6. A method of varying a fluid pressure differential across a load sensing control valve in a variable fluid displacement pump having a movable swashplate, the steps of the method comprising, connecting said pump by a fluid pressure line to a fluid pressure load, connecting said load sensing control valve to said fluid pressure line, connecting said load sensing control valve to said fluid pressure load with a load sensing signal line, the fluid pressure differential being defined as a pressure difference between the fluid pressure line and the load sensing signal line at the load sensing control valve, providing a servo means downstream of the load sensing control valve and coupled to the swashplate so as to move said swashplate and thereby vary the displacement of the pump, connecting said load sensing control valve to the servo means with a servo control pressure line and providing a hydraulic servo control pressure signal from said load sensing control valve to said servo means based upon the fluid pressure differential across the load sensing control valve, imposing a drain line including a variable orifice connected to the servo control pressure line between said load sensing control valve and said servo means to automatically modulate the hydraulic servo control pressure signal reaching said servo means, controlling the size of said variable orifice by mechanical feedback from said swashplate.

7. A variable orifice for a servo conduit in a variable fluid displacement pump, comprising:

a housing having a servo bore therein, an elongated servo piston longitudinally slidable in said servo bore and having a transverse cross sectional area that varies along the length thereof whereby a gap defined between said housing and said servo piston also varies along the length of the servo piston.

8. The variable orifice of claim 7 wherein the servo piston is cylindrical and has a length and an outer diameter with a slot extending longitudinally therein, the slot having at least one dimension which uniformly varies along the length of the servo piston.

9. The variable orifice of claim 8 wherein the slot has a depth which uniformly varies along a straight tapered bottom surface along the length of the slot.

* * * * *